US007376979B2

(12) United States Patent
Nilsen

(10) Patent No.: US 7,376,979 B2
(45) Date of Patent: May 27, 2008

(54) EXERCISE GARMENT

(76) Inventor: Michael B. Nilsen, 446 N. 85th Ave. W., Duluth, MN (US) 55807-1756

( * ) Notice: Subject to any disclaimer, the term of this patent is extended or adjusted under 35 U.S.C. 154(b) by 0 days.

(21) Appl. No.: 11/418,285

(22) Filed: May 4, 2006

(65) Prior Publication Data

US 2007/0256206 A1 Nov. 8, 2007

(51) Int. Cl.
*A41D 13/00* (2006.01)

(52) U.S. Cl. ..... 2/69

(58) Field of Classification Search ..... 2/69, 2/115, 227, 228, 238, 79, 94, 108, 2.5; 482/105, 482/74, 139
See application file for complete search history.

(56) References Cited

U.S. PATENT DOCUMENTS 1,448,811 A 3/1923 Morrison
1,532,362 A 4/1925 Bailey
3,759,510 A * 9/1973 Jackson, Jr. ..... 482/105
3,889,313 A 6/1975 Hulthen
4,384,369 A * 5/1983 Prince ..... 2/79
5,553,322 A * 9/1996 Cebo-Johnson ..... 2/69
5,937,441 A * 8/1999 Raines ..... 2/69
5,951,446 A 9/1999 Monforte
5,978,964 A * 11/1999 Gaston ..... 2/69
6,209,135 B1 * 4/2001 Irvin ..... 2/102

* cited by examiner

*Primary Examiner*—Tejash Patel

(57) ABSTRACT

An exercise garment which is stylish and which can be worn on its own. The garment includes various shaped pockets that are located to be out of the way with respect to the activities of the wearer. A rubber-covered weights is contained in each pocket and is shaped and sized to correspond to the size and shape of the pocket in order to fit snugly into the pocket in which it is accommodated.

1 Claim, 1 Drawing Sheet

EXERCISE GARMENT

TECHNICAL FIELD OF THE INVENTION

The present invention relates to the general art of physical fitness, and to the particular field of exercise wearing apparel.

BACKGROUND OF THE INVENTION

In modern times the population at large has increasingly become aware of the importance of physical conditioning as a program for maintaining and improving a person's health generally, for improving physical prowess in sporting activities, and also for improving physical appearance.

Furthermore, it is known that the bone mineral density of people, and women in particular, decreases with age. This leads to the onset of osteoporosis and an increased likelihood of bone fractures due to frail bones. It is also known that physical fitness, in the category of weight bearing resistance exercise, and the increased muscle mass associated with such physical fitness is closely related to bone mineral density. That is, the more one engages in such physical fitness, the greater the muscle density will be, and hence, the greater the bone mineral density will be. Bone mineral density is also correlated to body weight, and the greater the body weight, the greater the bone mass. This correlation between body weight and bone mineral density is referred to as Wolff's law, which provides that bone remodeling is directly dependent on the mechanical load placed on the bone.

As can be appreciated, those who have greater bone mineral density are at less of a risk of being osteoporitic and of incurring osteoporitic bone fractures. However, not all people are capable of engaging in exercises which will increase bone mass. And gaining weight to increase bond mineral density is not a healthy choice. One way of increasing bone mass is to engage in weight training Persons training for athletics and undergoing physical therapy often include work-outs with weights to increase and speed their progress. Weights are often used in strength, endurance, and muscle building exercises are often used by increasing resistance and intensifying the workout. Free weights, such as hand weights, are useful for exercising every muscle in the body. However, such free weights, as well as exercise machines, generally require a great deal of floor space and thus must be stored at a gym or other such location to which the exerciser must travel. Travel is often inconvenient and may act as a deterrent to an on-going and continuous exercise program to which the exerciser will adhere. Furthermore, a person must set aside specific times to go to the gym or exercise location. This also can be inconvenient. As such, many exercise programs are discontinued because of time constraints or the inconvenience of performing the weight exercise, or simply the nuisance of traveling and settings aside exercise time.

Accordingly, the art has developed wearing apparel that incorporates weights into various designs. By inclusion of the weights in the garment itself, the wearer enjoys further benefits from the added resistance. However, the weighted garments known to the inventor are cumbersome, uncomfortable and certainly non-stylish and non-attractive. Still further, some of the weighted garments known to the inventor are intended to be worn over, or under, other garments. This makes such garments even more cumbersome and uncomfortable. Still further, the weights are often located in areas that may interfere with the wearer's activities. As such, many people do not wear such weighted garments.

Still further, none of the garments known to the inventor are stylish and easy and comfortable to wear. For example, many of the garments known to the inventor have weights that can move during movement of the user thereby becoming uncomfortable and distracting. In fact, in many instances, the weights, themselves, can be distracting. Accordingly, there is a need for a weighted garment that is attractive, stylish and comfortable to wear and will not distract a wearer.

SUMMARY OF THE INVENTION

The above-discussed disadvantages of the prior art are overcome by wearing apparel that is stylish and which contains several pockets located in positions that are out of the way with respect to activities performed by a person wearing the wearing apparel. The pockets have various shapes so they will not obstruct the motion of the wearer, and will add to the overall aesthetic appearance of the wearing apparel. The wearing apparel includes rubber-covered weights that are each shaped to have a shape and size that matches the shape of the pocket in which it is accommodated whereby the weights will not slip or move around in the pockets once they are placed so the weights will not annoy a wearer or endanger the apparel by moving around during wear.

Using the wearing apparel embodying the present invention will permit a user to obtain the benefits of worn weight garments yet without the disadvantages associated with known garments, such as annoyance, non-stylish garments, intrusion on the wearer's activities, and the like.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figures 1, 2, 3, 4:
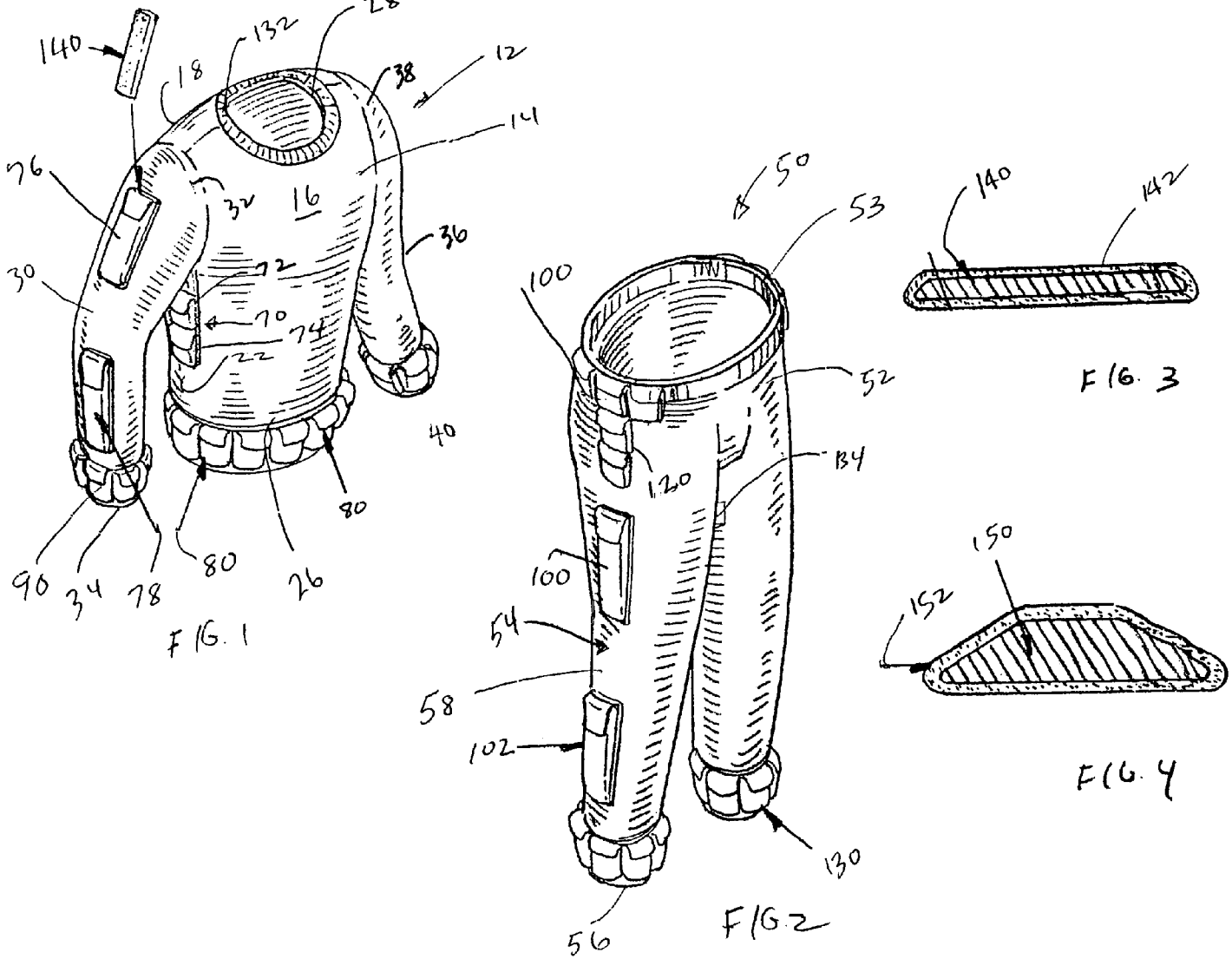
FIG. 1 is a perspective view of a jacket embodying the present invention.
FIG. 2 is a perspective view of trousers embodying the present invention.
FIG. 3 is a cross sectional view of a weight used in the invention embodying the present invention.
FIG. 4 is a cross sectional view of another weight used in the invention embodying the present invention.

Referring to the figures, it can be understood that the present invention is embodied in an exercise garment that overcomes the above-discussed disadvantages of the prior art. The garment embodying the present invention comprises an upper torso-accommodating portion 12 having a first portion 14 that fits over a wearer's upper torso when in use. Portion 14 includes a first section 16 that is located adjacent to the wearer's chest area when the first portion is being worn, a second section 18 which is located adjacent to the wearer's back when the first portion is being worn, and two identical side sections, such as side section 22, which connect the first section of the first portion to the second section of the first portion.

Portion 14 further includes a first end 26 which is located adjacent to the wearer's hips when the first portion is being worn and a second end 28 which is located adjacent to the wearer's neck when the first portion is being worn. A first sleeve section 30 has one end 32 attached to one of the side sections and a second end 34 that is located adjacent to the wearer's wrist when the first portion is being worn. A second sleeve section 36 has one end 38 attached to a second side section of the side sections and a second end 40 that is located adjacent to the wearer's wrist when the first portion is being worn.

The garment further comprises a second portion 50 that fits over the wearer's lower body when the second portion is being worn. Second portion 50 includes a first section 52 that fits over the wearer's hip region and has a first end 53 that is located adjacent to the wearer's waist when the second portion is being worn and two identical leg sections, such as leg section 54, that fit over the wearer's legs when the second portion is being worn. Each leg section has a second end 56 which is located adjacent to the wearer's ankle when the second portion is being worn. Each leg portion further includes a side section 58 that is located adjacent to the wearer's side when the second portion is being worn.

The garment further comprises a weight system. The weight system includes a first pocket unit 70 located on the side section of the first portion beneath the arm section. First pocket unit 70 includes two identical pockets 72 and 74. Each pocket of the first pocket unit is rectangular in shape, the pockets of the first pocket unit are located and positioned to be spaced apart from each other in an upright direction when the first portion is being worn.

Two second pocket units 76 and 78 are located on each sleeve. Each pocket unit of the second pocket units is rectangular in shape and is elongated so as not to be square. A plurality of third pocket units 80 are attached to the first portion adjacent to the first end of the first portion and which encircle the wearer's waist when the first portion is being worn. Each pocket of the third pocket units is rectangular in shape.

A fourth set of pocket units 90 is attached to each sleeve section of the first portion adjacent to the second end of the sleeve section and encircle the wearer's wrist when the first portion is being worn. The pockets of the fourth set of pocket units are rectangular in shape.

Two fifth pocket units 100 and 102 are located on each leg section. Each pocket unit of the fifth pocket units is rectangular in shape and is elongated. A plurality of sixth pocket units 110 is located on first section 52 of second portion 50. Each pocket unit of the sixth pocket unit is located adjacent to first end 53 of the first section of the second portion when the second portion is being worn. Each pocket unit of the sixth pocket units is rectangular in shape and is horizontally spaced apart from an adjacent pocket unit of the sixth pocket unit when the second portion is being worn.

A plurality of seventh pockets 120 is attached to second portion 50 adjacent to first end 53 of the first section of the second portion. Pockets 120 are rectangular in shape and are located between the sixth pockets of an adjacent sixth pocket unit. The seventh pockets are spaced apart from each other in an upright direction and are spaced apart from an adjacent fifth pocket 100 in an upright direction unit when the second portion is being worn.

A plurality of eighth pockets 130 are mounted on the second section of the second portion adjacent to second end 56 of each leg section. The eighth pockets surround the ankles of the wearer when the second portion is being worn and are rectangular in shape. In one form of the garment, a further set of pockets 132 are located adjacent to the wearer's neck. Yet another form of the garment has pockets 134 on the legs of the garment.

The garment further comprises a first set of weights 140. Each weight of the first set of weights is rectangular in cross sectional shape and has a rubber case 142 in which it is enclosed as can be understood from FIG. 3. The garment further comprises a second set of weights 150. Each weight of the second set of weights has a pentagonal cross sectional shape as shown in FIG. 4 and has a rubber case 152 in which it is enclosed.

Smaller weights can be accommodated in pockets 132 and 134. The weights fit into the pockets of the garment and are shaped to correspond to the shape of the pocket in which it is accommodated. Due to the shape and the rubber case for each weight, the weights will not slip or move around in the pocket. The weights can be of various sizes, such as one pound weights, five pound weights, or even ten pound weights. Some or all of the pockets can be used, or the like as needed. For example, if a user merely wants to exercise his or her arms, only pocket units 76 and/or 78 can be used, and so forth. This will allow the user a choice of what muscles can be exercised as well as the added weight burning calories.

The garments can be slacks, shirts, sweaters, suits, dresses, jackets, swimming wear, nightwear, even underwear, running suits or even business suits. This provides a great deal of versatility to the garment. Use of the garment will be understood from the foregoing and thus will only be briefly discussed. A user dons either or both portions of the garment and adds weights to the pockets as desired. The user then carries out his or her normal tasks and the weight added by the garment will burn extra calories for that user. The user can perform a variety of tasks because the garment is stylish and the weights are securely held in position so it will not interfere with normal activities either aesthetically or physically.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. An exercise garment consisting of:

A) a first portion that is worn on the upper torso of a wearer and which includes sleeves and an end that is located adjacent to the wearer's waist when the first portion is worn;

B) a second portion that is worn on the lower body of the wearer and which includes leg sections and a first end that is located adjacent to the waist of the wearer when the second portion is being worn, each leg having a second end that is located adjacent to the wearer's ankle when the second portion is worn;

C) a plurality of pockets which includes (1) a first set of pockets located on the first portion adjacent to the sleeves, the pockets of the first set of pockets being rectangular, (2) a second set of pockets located on the sleeves, the pockets of the second set of pockets being rectangular and elongated, (3) a third set of pockets located adjacent to the end of the first portion that is located adjacent to the wearer's waist when the first portion is worn, the third set of pockets encircling the Wearer's waist and being rectangular, (4) a fourth set of pockets encircling a wearer's wrist when the first portion is worn, (5) a fifth set of pockets on the legs of the second portion, (6) a sixth set of pockets mounted on the second portion adjacent to the first end of the second portion, (7) a seventh set of pockets mounted on the second portion adjacent to the pockets of the sixth set of pockets, (8) an eighth set of pockets mounted on the legs adjacent to the second end of the legs and encircling the wearer's ankles when the second portion is worn;

D) a first set of weights, each weight of the first set of weights being rectangular in cross sectional shape and having a rubber case in which it is enclosed; and E) a second set of weights, each weight of the second set of weights having a pentagonal cross sectional shape and having a rubber case in which it is enclosed.

* * * * *